US009017431B2

(12) United States Patent
Fang et al.

(10) Patent No.: US 9,017,431 B2
(45) Date of Patent: Apr. 28, 2015

(54) GASOLINE FUEL COMPOSITION FOR IMPROVED PERFORMANCE IN FUEL INJECTED ENGINES

(71) Applicants: Xinggao Fang, Midlothian, VA (US); Scott D. Schwab, Richmond, VA (US)

(72) Inventors: Xinggao Fang, Midlothian, VA (US); Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 359 days.

(21) Appl. No.: 13/742,703

(22) Filed: Jan. 16, 2013

(65) Prior Publication Data

US 2014/0196678 A1 Jul. 17, 2014

(51) Int. Cl.

| | |
|---|---|
| ***C10L 1/22*** | (2006.01) |
| ***C10L 10/18*** | (2006.01) |
| ***F02B 51/00*** | (2006.01) |
| ***C10L 1/222*** | (2006.01) |
| ***C10L 1/2383*** | (2006.01) |
| ***C10L 10/04*** | (2006.01) |
| ***C10L 10/06*** | (2006.01) |

(52) U.S. Cl.

CPC ..... *C10L 10/18* (2013.01); *F02B 51/00* (2013.01); *C10L 1/221* (2013.01); *C10L 2270/023* (2013.01); *C10L 1/2222* (2013.01); *C10L 1/2383* (2013.01); *C10L 10/04* (2013.01); *C10L 10/06* (2013.01); *C10L 2200/0423* (2013.01)

(58) Field of Classification Search

CPC ..... C10L 10/18; C10L 1/221; C10L 1/2222; C10L 1/2383; C10L 10/04; C10L 10/06; F02B 51/00

See application file for complete search history.

(56) References Cited

U.S. PATENT DOCUMENTS

| | | | | |
|---|---|---|---|---|
| 3,015,668 | A | 1/1962 | Kozikowski | |
| 3,092,474 | A | 6/1963 | Ebner | |
| 3,198,613 | A * | 8/1965 | Udelhofen | 44/403 |
| 3,468,640 | A | 9/1969 | Barusch et al. | |
| 3,778,371 | A | 12/1973 | Malec | |
| 4,056,531 | A | 11/1977 | Malec | |
| 4,171,959 | A | 10/1979 | Vartanian | |
| 4,248,719 | A | 2/1981 | Chafetz et al. | |
| 4,253,980 | A | 3/1981 | Hammond et al. | |
| 4,326,973 | A | 4/1982 | Hammond et al. | |
| 4,338,206 | A | 7/1982 | Hammond et al. | |
| 4,482,357 | A | 11/1984 | Hanlon | |
| 4,787,916 | A | 11/1988 | Feldman | |
| 5,254,138 | A | 10/1993 | Kurek | |
| 5,575,823 | A | 11/1996 | Wallace et al. | |
| 5,752,989 | A | 5/1998 | Henly et al. | |
| 5,855,629 | A | 1/1999 | Grundy et al. | |
| 7,906,470 | B2 | 3/2011 | Stevenson et al. | |
| 7,947,093 | B2 | 5/2011 | Barton et al. | |
| 7,951,211 | B2 | 5/2011 | Barton et al. | |
| 8,863,700 | B2 * | 10/2014 | Fang et al. | 123/1 A |
| 8,894,726 | B2 * | 11/2014 | Fang et al. | 44/408 |
| 2003/0131527 | A1 | 7/2003 | Colucci et al. | |
| 2008/0113890 | A1 | 5/2008 | Moreton et al. | |
| 2010/0236510 | A1 | 9/2010 | Shea et al. | |
| 2011/0315107 | A1 | 12/2011 | Grabarse et al. | |

FOREIGN PATENT DOCUMENTS

| | | | |
|---|---|---|---|
| EP | 0293192 | B1 | 11/1991 |
| EP | 2033945 | A1 | 3/2009 |
| WO | 0142399 | A1 | 6/2001 |
| WO | 2011110860 | A1 | 9/2011 |
| WO | 2011141731 | A1 | 11/2011 |
| WO | 2011149799 | A1 | 12/2011 |

* cited by examiner

*Primary Examiner* — Cephia D Toomer

(74) *Attorney, Agent, or Firm* — Luedeka Neely Group, P.C.

(57) ABSTRACT

A method for improving performance of fuel injectors, and a method for cleaning fuel injectors for an internal combustion engine. The methods include operating the engine on a fuel composition comprising a major amount of fuel and from about 1 to about 200 ppm by weight based on a total weight of the fuel of a reaction product of (i) a hydrocarbyl substituted compound containing at least one tertiary amino group and (ii) a halogen substituted C2-C8 carboxylic acid, ester, amide, or salt thereof, wherein the reaction product as made is substantially devoid of free anion species.

20 Claims, No Drawings

GASOLINE FUEL COMPOSITION FOR IMPROVED PERFORMANCE IN FUEL INJECTED ENGINES

TECHNICAL FIELD

The disclosure is directed to gasoline fuel additives and to additive and additive concentrates that include the additive that are useful for improving the performance of gasoline fuel injected engines. In particular, the disclosure is directed to additives for port fuel injection gasoline engines as well as direct injection gasoline (DIG) engines.

BACKGROUND AND SUMMARY

It has long been desired to maximize fuel economy, power and driveability in gasoline powered vehicles while enhancing acceleration, reducing emissions, and preventing hesitation. While it is known to enhance gasoline powered engine performance by employing dispersants to keep valves and fuel injectors clean in port fuel injection engines, such gasoline dispersants are not necessarily effective for cleaning up direct fuel injected engines. The reasons for this unpredictability may lie in the many mechanical and operational differences between the direct and port fuel injected engines and the fuels suitable for such engines.

With the current use of direct fuel injected gasoline engines, dispersants that previously could have been used for gasoline engines do not work for both direct injected engines and port fuel injected engines. For example Mannich dispersants that were used in port fuel injected gasoline engines fail to provide suitable improvement in direct injected gasoline engines.

Over the years, dispersant compositions for gasoline fuels have been developed. Dispersant compositions known in the art for use in fuels include compositions that may include polyalkylene succinimides, polyalkenepolyamines, polyetheramines, and polyalkyl substituted Mannich compounds. Dispersants are suitable for keeping soot and sludge suspended in a fluid, however dispersants are not particularly effective for cleaning surfaces once deposits have formed on the surfaces. Fuel compositions for direct fuel injected engines often produce undesirable deposits in the engine combustion chambers, fuel supply systems, fuel filters, etc. Accordingly, improved compositions that can prevent deposit build up, maintaining "as new" cleanliness for the vehicle life are desired. Ideally, the same composition that can clean up dirty fuel injectors restoring performance to the previous "as new" condition would be equally desirable and valuable in the attempt to reduce air borne exhaust emissions and to improve the power performance of the engines.

Some additives, such as quaternary ammonium salts that have cations and anions bonded through ionic bonding, have been used in fuels but may have reduced solubility in the fuels and may form deposits in the fuels under certain conditions of fuel storage or engine operation. Also, such quaternary ammonium salts may not be effective for use in fuels containing components derived from renewable sources. Accordingly, there continues to be a need for fuel additives that are effective in cleaning up fuel injector or supply systems and maintaining the fuel injectors operating at their peak efficiency.

In accordance with the disclosure, exemplary embodiments provide a method for improving performance of fuel injectors, and a method for cleaning fuel injectors for an internal combustion engine. The methods include operating the engine on a fuel composition comprising a major amount of fuel and from about 1 to about 200 ppm by weight based on a total weight of the fuel of a reaction product of (i) a hydrocarbyl substituted compound containing at least one tertiary amino group and (ii) a halogen substituted $C_2$-$C_8$ carboxylic acid, ester, amide, or salt thereof, wherein the reaction product as made is substantially devoid of free anion species.

A further embodiment of the disclosure provides a method of operating a fuel injected gasoline engine. The method includes combusting in the engine a fuel composition comprising a major amount of fuel and from about 1 to about 200 ppm by weight based on a total weight of the fuel of a reaction product of (i) a hydrocarbyl substituted compound containing at least one tertiary amino group and (ii) at least one halogen substituted $C_2$-$C_8$ carboxylic acid, ester, amide, or salt thereof, wherein the reaction product as made is substantially devoid of free anion species.

An advantage of the fuel additive described herein is that the additive may not only reduce the amount of deposits forming on direct fuel injectors, but the additive may also be effective to clean up dirty fuel injectors sufficient to provide improved engine performance.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The reaction product of embodiments of the disclosure may be used in minor amounts in a major amount of fuel and may be added to the fuel directly or added as a component of an additive concentrate to the fuel. A particularly suitable reaction product for improving the operation of internal combustion engines may be made by a wide variety of well known reaction techniques with amines or polyamines. For example, such additive component may be made by reacting a tertiary amine of the formula

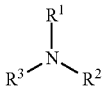

wherein each of $R^1$, $R^2$, and $R^3$ is selected from hydrocarbyl groups containing from 1 to 200 carbon atoms, with a halogen substituted $C_2$-$C_8$ carboxylic acid, ester, amide, or salt thereof What is generally to be avoided in the reaction is quaternizing agents selected from the group consisting of hydrocarbyl substituted carboxylates, carbonates, cyclic-carbonates, phenates, epoxides, or mixtures thereof In one embodiment, the halogen substituted $C_2$-$C_8$ carboxylic acid, ester, amide, or salt thereof may be selected from chloro-, bromo-, fluoro-, and iodo-$C_2$-$C_8$ carboxylic acids, esters, amides, and salts thereof The salts may be alkali or alkaline earth metal salts selected from sodium, potassium, lithium calcium, and magnesium salts. A particularly useful halogen substituted compound for use in the reaction is the sodium salt of a chloroacetic acid.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as carbonyl, amido, imido, pyridyl, furyl, thienyl, ureyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

As used herein the term "substantially devoid of free anion species" means that the anions, for the most part are covalently bound to the product such that the reaction product as made does not contain any substantial or detectible amounts of free anions or anions that are ionically bound to the product.

Amine Compound

In one embodiment, a tertiary amine including monoamines and polyamines may be reacted with the halogen substituted acetic acid or derivative thereof. Suitable tertiary amine compounds of the formula

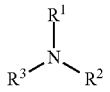

wherein each of $R^1$, $R^2$, and $R^3$ is selected from hydrocarbyl groups containing from 1 to 200 carbon atoms may be used. Each hydrocarbyl group $R^1$ to $R^3$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amido groups, ester groups, imido groups, and the like. Particularly suitable hydrocarbyl groups may be linear or branched alkyl groups. Some representative examples of amine reactants which can be reacted to yield compounds of this invention are: trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N-methyl piperidine, N,N'-dimethyl piperazine, N-methyl-N-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexamethylene tetramine, N,N,N',N'-tetramethylethylenediamine, N,N,N',N'-tetramethylpropylenediamine, N,N,N',N'-tetraethyl- 1,3-propanediamine, methyldicyclohexyl amine, 2,6-dimethylpyridine, dimethylcylohexylamine, $C_{10}$-$C_{30}$-alkyl or alkenyl-substituted amidopropyldimethylamine, $C_{12}$-$C_{200}$-alkyl or alkenyl-substituted succinic-carbonyldimethylamine, and the like.

If the amine contains solely primary or secondary amino groups, it is necessary to alkylate at least one of the primary or secondary amino groups to a tertiary amino group prior to the reaction with the halogen substituted $C_2$-$C_8$ carboxylic acid, ester, amide, or salt thereof. In one embodiment, alkylation of primary amines and secondary amines or mixtures with tertiary amines may be exhaustively or partially alkylated to a tertiary amine. It may be necessary to properly account for the hydrogens on the nitrogens and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine for further reaction.

The halogen substituted $C_2$-$C_8$ carboxylic acid, ester, amide, or salt thereof may be derived from a mono-, di-, or trio- chloro- bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof. The salts of the carboxylic acids may include the alkali or alkaline earth metal salts, or ammonium salts including, but not limited to the Na, Li, K, Ca, Mg, triethyl ammonium and triethanol ammonium salts of the halogen-substituted carboxylic acids. A particularly suitable component may be selected from chloroacetic acid and sodium chloroacetate. The amount of halogen substituted $C_2$-$C_8$ carboxylic acid, ester, amide, or salt thereof relative to the amount of tertiary amine reactant may range from a molar ratio of about 1:0.1 to about 0.1:1.0.

In some aspects of the present application, the reaction product of the compositions of this disclosure may be used in combination with a fuel soluble carrier. Such carriers may be of various types, such as liquids or solids, e.g., waxes. Examples of liquid carriers include, but are not limited to, mineral oil and oxygenates, such as liquid polyalkoxylated ethers (also known as polyalkylene glycols or polyalkylene ethers), liquid polyalkoxylated phenols, liquid polyalkoxylated esters, liquid polyalkoxylated amines, and mixtures thereof. Examples of the oxygenate carriers may be found in U.S. Pat. No. 5,752,989, issued May 19, 1998 to Henly et. al., the description of which carriers is herein incorporated by reference in its entirety. Additional examples of oxygenate carriers include alkyl-substituted aryl polyalkoxylates described in U.S. Patent Publication No. 2003/0131527, published Jul. 17, 2003 to Colucci et. al., the description of which is herein incorporated by reference in its entirety.

In other aspects, the reaction products may not contain a carrier. For example, some compositions of the present disclosure may not contain mineral oil or oxygenates, such as those oxygenates described above.

One or more additional optional compounds may be present in the fuel compositions of the disclosed embodiments. For example, the fuels may contain conventional quantities of nitrogen-containing detergents, octane improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, cyclomatic manganese tricarbonyl compounds, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, and the like.

Examples of suitable optional metal deactivators useful in the compositions of the present application are disclosed in U.S. Pat. No. 4,482,357 issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. No. 5,575,823, issued Nov. 19, 1996, and U.S. Pat. No. 3,015,668, issued Jan. 2, 1962, both of which disclosures are herein incorporated by reference in their entirety.

Commercially available detergents may be used in combination with the reaction products described herein. Such detergents include but are not limited to succinimides, Mannich base detergents, polyhydrocarbyl amine detergents, quaternary ammonium detergents, bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

When formulating the fuel compositions of this application, the additives may be employed in amounts sufficient to reduce or inhibit deposit formation in a fuel system or combustion chamber of an engine and/or crankcase. In some aspects, the fuels may contain minor amounts of the above described reaction product that controls or reduces the formation of engine deposits, for example injector deposits in gasoline engines. For example, the gasoline fuels of this application may contain, on an active ingredient basis, an amount of the reaction product in the range of about 5 mg to about 200 mg of reaction product per Kg of fuel, such as in the range of about 10 mg to about 150 mg of per Kg of fuel or in the range of from about 30 mg to about 100 mg of the reaction product per Kg of fuel. In aspects, where a carrier is employed, the fuel compositions may contain, on an active ingredients basis, an amount of the carrier in the range of about 1 mg to about 100 mg of carrier per Kg of fuel, such as about 5 mg to about 50 mg of carrier per Kg of fuel. The active ingredient basis excludes the weight of (i) unreacted components associated with and remaining in the product as produced and used, and (ii) solvent(s), if any, used in the manufacture of the product either during or after its formation but before addition of a carrier, if a carrier is employed.

The additives of the present application, including the reaction product described above, and optional additives used in formulating the fuels of this invention may be blended into the base fuel individually or in various sub-combinations. In some embodiments, the additive components of the present application may be blended into the gasoline fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of gasoline engines. The engines include both stationary engines (e.g., engines used in electrical power generation installations, in pumping stations, etc.) and ambulatory engines (e.g., engines used as prime movers in automobiles). For example, the fuels may include any and all gasoline fuels, biorenewable fuels, gas-to-liquid (GTL) fuels, synthetic fuels, such as Fischer-Tropsch fuels, biomass to liquid (BTL) fuels, "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol.

Accordingly, aspects of the present application are directed to methods for reducing the amount of injector deposits of engines having at least one combustion chamber and one or more direct fuel injectors in fluid connection with the combustion chamber. In another aspect, the quaternary ammonium salts described herein may be combined with relatively high molecular weight quaternary ammonium salts having one or more polyolefin groups; such as quaternary ammonium salts of polymono-olefins, polyhydrocarbyl succinimides; polyhydrocarbyl Mannich compounds: polyhydrocarbyl amides and esters, wherein "relatively high molecular weight" means having a number average molecular weight of greater than 600 Daltons. The foregoing quaternary ammonium salts may be disclosed for example in U.S. Pat. Nos. 3,468,640; 3,778,371; 4,056,531; 4171,959; 4,253,980; 4,326,973; 4,338,206; 4,787,916; 5,254,138: 7,906,470; 7,947,093; 7,951,211; U.S. Publication No. 2008/0113890; European Patent application Nos. EP 0293192; EP 2033945; and PCT Application No. WO 2011/110860.

In some aspects, the methods comprise injecting a hydrocarbon-based fuel comprising the reaction product of the present disclosure through the injectors of the engine into the combustion chamber, and igniting the fuel. In some aspects, the method may also comprise mixing into the fuel at least one of the optional additional ingredients described above. The fuel compositions described herein are suitable for both direct and port fuel injected engines.

In one embodiment, the fuels of the present application may be essentially free, such as devoid, of conventional succinimide dispersant compounds. In another embodiment, the fuel is essentially free of quaternary ammonium salts of a hydrocarbyl succinimide or quaternary ammonium salts of a hydrocarbyl Mannich compound having a number average molecular weight of greater than 600 Daltons. The term "essentially free" is defined for purposes of this application to be concentrations having substantially no measurable effect on injector cleanliness or deposit formation.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Inventive Example 1

A polyisobutylene succinimide (PIBSI) detergent was prepared by reaction of polyisobutylene succcinic anhydride (PIBSA) with dimethylaminopropyl-amine (DMAPA) by a well known method, such as the modified procedure of U.S. Pat. No. 5,752,989. The resulting PIBSI (200 g, 78 wt. % in an aromatic solvent) was combined with 17.8 grams of sodium chloroacetate (SCA), 81 grams of deionized water, 58 grams of aromatic solvent, and 76 grams of isopropanol and heated at 80° C. for 2.5 hours, then at 85° C. for 1 hour. The reaction product was extracted with heptanes and the heptanes layer was washed with water five times to remove sodium chloride from the reaction product. Volatiles were removed from the reaction product under reduced pressure to give a salt product that was a brownish oil.

Inventive Example 2

The reaction product was made similar to that of Inventive Example 1, except that the 950 number average molecular weight PIBSA was replaced with 1300 number average molecular weight PIBSA and the reaction mixture was mixed with toluene to remove water by azeotropic distillation and the resulting product was filtered using a diatomaceous earth filter rather than extracted with heptanes in order to remove sodium chloride from the reaction product. Volatiles were removed from the reaction product under reduced pressure to give a salt product that was a brownish oil.

Inventive Example 3

The reaction product was made similar to Inventive Example 2 with the exception that the 1300 number average molecular weight PIBSI was replaced with oleylamido propyl dimethylamine (OD). The reaction product was mixed with an aromatic solvent and 2-ethylhexanol to provide a yellow liquid.

Inventive Example 4

The reaction product was made similar to Inventive Example 2 with the exception that oleylamido propyl dimethylamine (OD) was replaced with oleydimethylamine. The reaction product was mixed with 2-ethylhexanol to provide a yellow liquid.

Port Fuel Injectors (PFI) Bench Test Protocol ASTM D6421 Modified

The following test method is a bench test procedure that was used to evaluate the tendency of automotive spark-ignition engine fuels to foul electronic port fuel injectors (PFI) in a spark ignition engine. The test method used a bench apparatus equipped with Bosch injectors specified for use in a 1985-1987 Chrysler 2.2-L turbocharged engine. The test method was based on a test procedure developed by the Coordinating Research Council (CRC Report No. 592) for predicting the tendency of spark-ignition engine fuel to form deposits in small metering clearances of fuel injectors in a port fuel injection engine. Fuel injector fouling was calculated according to the following equation:

$$F_o = \frac{F_1 - F_2}{F_1} \times 100$$

where $F_0$ is the percent fouling, $F_1$ is an initial flow mass in tenths of a gram, and $F_2$ is a flow mass at the end of the test in tenths of a gram. The percent fouling was calculated for each injector for three flow mass readings and the average of four injectors was reported in percent.

TABLE 1

| Run No. | Additives and treat rate (ppm by weight) | Average % Fouling ($F_o$) |
|---|---|---|
| 1 | Base Fuel | 54.5 |
| 2 | Base Fuel Plus Conventional Mannich Detergent[1] (75 ppmw) | 21.44 |
| 3 | Base Fuel Plus Compound of Inventive Example 2 (75 ppmw) | 0.22 |
| 4 | Base Fuel Plus Compound of Inventive Example 3 (75 ppmw) | 0.36 |
| 5 | Base Fuel Plus Compound of Inventive Example 3 (75 ppmw) | 0.44 |
| 6 | Base Fuel Plus Compound of Inventive Example 4 (50 ppmw) | 1.53 |

[1]Reaction product of dibutylamine, polyisobutylene cresol (1000 $MW_n$) and formaldehyde as generally described in U.S. Pat. No. 7,491,248.

As shown by the foregoing table, a fuel containing the compound of Inventive Example 3 provided significant improvement in injector fouling in a port fuel injected gasoline engine as compared to the base fuel without any detergent and as compared to the same base fuel containing a conventional Mannich detergent.

An engine test measuring fuel injector deposit (referred to as "DIG test") was performed following a procedure disclosed in Society of Automotive Engineer (SAE) International publication 2009-01-2641 "Test and Control of Fuel Injector Deposits in Direct Injected Spark Ignition Vehicles". A mathematical value of Long Term Fuel Trim (LTFT) was used to gauge the ability of additive to keep deposit from accumulating in the injectors, or to keep injectors clean. The higher the LTFT, the more deposit in the injectors and the less effective is the additive in keeping injectors clean.

The test may also be used to gauge the effectiveness of additives to clean up the injectors in a gasoline engine by running a standard 48 hour dirty up phase followed by a 48 hour clean up phase.

For the DIG test, a 2008 General Motors Pontiac Solstice GXP equipped with a DISI 2.0 liter turbocharged I-4 engine was used. The results are shown in the following table.

TABLE 2

| Run No. | Additives and treat rate (ppm by weight) | Normalized LTFT % | % Improvement |
|---|---|---|---|
| 1 | Gasoline with no additive | 8.0 | — |
| 2 | Compound of Inventive Example 3 (75 ppmw) | 1.0 | 87.5 |

TABLE 3

| Run No. | Additives and treat rate (ppm by weight) | Normalized LTFT % | % Improvement |
|---|---|---|---|
| 3 | Gasoline with typical Mannich detergent[2] (81 ppmw) | 9.3 | — |
| 4 | Fuel and additive of Run 3 plus 8 ppm of Inventive Example 3 as a top treat | 3.8 | 59.1 |

[2]Mannich detergent as described in Table 1.

Run 1 shows the effects of gasoline with no additive on injectors in a directed injected gasoline engine. Run 2 containing the compound of Example 3 showed a significant clean up dirty injectors for a DIG engine at a relatively low treat rate. Run 3 showed that gasoline containing a conventional Mannich detergent was not effective to keep the fuel injectors clean. Run 4 showed that a small amount of the reaction product of Example 3, used as top treat to the fuel of Run 3, was sufficient to clean up the dirty fuel injectors from Run No. 3.

TABLE 4

| Run No. | Additives and treat rate (ppm by weight) | Normalized LTFT % |
|---|---|---|
| 3 | Gasoline with typical Mannich detergent[2] (81 ppmw) | 9.3 |
| 5 | Fuel and additive of Run 3 plus 8 ppm of Inventive Example 3 | 0.0 |

[2]Mannich detergent as described in Table 1.

Table 5 showed that the Mannich detergent of Run 3 was not effective to keep the injectors clean. However, when the Mannich was combined with 8 ppm of the Inventive Example 3, the fuel was effective to keep the injectors clean.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method of improving the injector performance of a fuel injected gasoline engine comprising operating the engine on a fuel composition comprising a major amount of fuel and from about 1 to about 200 ppm by weight based on a total weight of the fuel of a reaction product of (i) a hydrocarbyl substituted compound containing at least one tertiary amino group and (ii) a halogen substituted $C_2$-$C_8$ carboxylic acid, ester, amide, or salt thereof, wherein the reaction product as made is substantially devoid of free anion species.

2. The method of claim 1, wherein the engine comprises a direct injected gasoline (DIG) engine.

3. The method of claim 1, wherein the engine comprises a port fuel injected (PFI) engine having an average fuel flow loss of less than 20 percent in a port fuel injection test.

4. The method of claim 1, wherein the halogen substituted carboxylic acid or salt thereof comprises an alkali metal chloroacetate.

5. The method of claim 1, wherein the hydrocarbyl group of the hydrocarbyl substituted compound is selected from the group consisting of linear, branched, substituted, cyclic, saturated, unsaturated compounds and compounds containing one or more hetero atoms.

6. The method of claim 1, wherein the hydrocarbyl groups of the hydrocarbyl substituted compound (i) are selected from alkyl, alkenyl, and alkanol groups.

7. The method of claim 1, wherein the hydrocarbyl substituted compound (i) comprises a hydrocarbyl-substituted, carbonyl-containing compound selected from the group consisting of acylated polyamines, fatty amide tertiary amines, fatty acid substituted tertiary amines, and fatty ester tertiary amines.

8. The method of claim 7, wherein the amines comprises $C_{10}$-$C_{30}$-alkyl or alkenyl-substituted amidopropyldimethylamines.

9. The method of claim 7, wherein the amines are selected from the group consisting of polyalkenyl succinic carbonyl amine, oleylamidopropyl dimethylamine, and cocoamidopropyl dimethylamine.

10. The method of claim 1, wherein the amine comprises a dimethyl-$C_8$-$C_{24}$ fatty amine.

11. The method of claim 1, wherein from about 0.1 to about 1.0 moles of (i) are reacted with from about 1.0 to about 0.1 moles of (ii).

12. The method of claim 1, wherein the amount of additive in the fuel ranges from about 10 to about 150 ppm by weight based on a total weight of the fuel.

13. The method of claim 1, wherein the amount of additive in the fuel ranges from about 30 to about 100 ppm by weight based on a total weight of the fuel.

14. The method of claim 1, wherein said improved engine performance comprises providing an average fuel flow loss of less than 10 percent in a port fuel injection test.

15. A method of operating a fuel injected gasoline engine comprising combusting in the engine a fuel composition comprising a major amount of fuel and from about 1 to about 200 ppm by weight based on a total weight of the fuel of a reaction product of (i) a hydrocarbyl substituted compound containing at least one tertiary amino group and (ii) a halogen substituted $C_2$-$C_8$ carboxylic acid, ester, amide, or salt thereof, wherein the reaction product as made is substantially devoid of free anion species.

16. The method of claim 15, wherein the hydrocarbyl substituted compound is selected from the group consisting of $C_{10}$-$C_{30}$-alkyl or alkenyl-substituted amidopropyldimethylamines, and $C_{12}$-$C_{200}$-alkyl or alkenyl-substituted succinic-carbonyldimethylamines.

17. The method of claim 15, wherein the hydrocarbyl group of the hydrocarbyl substituted compound is selected from the group consisting of linear, branched, substituted, cyclic, saturated, unsaturated compounds and compounds containing one or more hetero atoms.

18. The method of claim 15, wherein the halogen substituted acetic acid or salt thereof comprises alkali metal chloroacetate.

19. The method of claim 15, wherein the engine comprises a direct injected gasoline (DIG) engine.

20. The method of claim 15, wherein the engine comprises a port fuel injected (PFI) engine.

* * * * *